United States Patent [19]

Suganuma

[11] Patent Number: 4,941,666

[45] Date of Patent: Jul. 17, 1990

[54] GOLF CLUB, SET OF GOLF CLUBS, AND METHOD OF PRODUCING THE SAME

[76] Inventor: Noriyuki Suganuma, 2-9-17, Nagata-Minami, Minami-ku, Yokohama-shi, Kanagawa-ken, Japan

[21] Appl. No.: 86,549

[22] Filed: Aug. 18, 1987

[30] Foreign Application Priority Data

Aug. 27, 1986 [JP] Japan ..... 61-198945
Aug. 27, 1986 [JP] Japan ..... 61-198946

[51] Int. Cl.[5] ..... A63B 53/04

[52] U.S. Cl. ..... 273/169; 273/77 A; 273/171

[58] Field of Search ..... 273/77 A, 77 R, 164, 273/167 R, 169–172

[56] References Cited

U.S. PATENT DOCUMENTS 4,432,550 2/1984 Byars ..... 273/169

FOREIGN PATENT DOCUMENTS 397252 8/1933 United Kingdom ..... 273/169

OTHER PUBLICATIONS

"Dynamic New Ways to Match Clubs So They Feel The Same", by Larry Dennis, *Golf Digest,* Dec. 1976, pp. 60–65.

*Primary Examiner*—Martin P. Schwadron
*Assistant Examiner*—Allen J. Flanigan
*Attorney, Agent, or Firm*—Edmund M. Jaskiewicz

[57] ABSTRACT

A golf club which is used for so-called through-the-green shots from a tee shot to a shot causing a ball to be on a putting green, wherein said golf club comprises at least a club head (10) and a shaft (11), and a position of a center of mass (**16*a*, 16*b*) of said club head is substantially located in a front portion (hitting face side) of said club head in a static state of said golf club with respect to a central plane (A—A') which passes the center of said shaft (11**) and divides said club head into said front portion and a rear portion.

9 Claims, 4 Drawing Sheets

Ⓐ start of swing
Ⓑ start of down swing
Ⓒ impact

GOLF CLUB, SET OF GOLF CLUBS, AND METHOD OF PRODUCING THE SAME

BACKGROUND OF THE INVENTION

1. Field of the Invention

The present invention relates to golf clubs a set of golf clubs, and a method of making the same wherein each golf club has a club head structure having an improved position of the center of mass and is used for so-called through-the-green shots from a tee shot to a shot causing a ball to be on a putting green.

2. Prior Art

Conventional through-the-green golf clubs and those constituting a set of golf clubs have a club head structure wherein with respect to a central plane (A—A') which passes through the center of a shaft (11) and divides a club head (10) into front (hitting face) and rear portions, the position (17) of the center of the mass of a club head is located in the rear portion of the club head or substantially on the central plane, as shown in FIG. 3 (wood club head) and FIG. 4 (iron club head).

Some sets of golf clubs are constituted by a plurality of golf clubs such as woods whose depth of the center of gravity is increased as the club length is increased and, on the contrary irons whose depth of the center of gravity is decreased as the club length is increased. In this manner, the theoretical background about dynamic correlation between the depth of the center of gravity and dynamic flex of shaft due to the swing is left unclear.

The problems of conventional through-the-green golf clubs and those constituting a set of golf clubs will be described below with reference to the accompanying drawings.

As shown in FIGS. 6 and 7, the conventional golf clubs have a club head structure in which the position of the center of mass is as follows. More specifically, when the golf club is in a dynamic state immediately before the impact during golf swing, a club head end side portion is flexed forward (toward a ball flying direction) due to the inertia of the club head mass (as compared to a static state of the club), and impact occurs immediately thereafter.

The dynamic phenomenon due to the conventional golf club swing has been often reviewed in magazines as sequential photographs, and is well known. For example, a book "THE SEARCH FOR THE PERFECT SWING; by Alistair Cochran & John Stobbs, (1968) announces the measurement results shown in (FIG. 7). In FIG. 7, the swing was made by a professional golf player. Positive values indicated in units of inches in FIG. 7 represent that a club head is flexed forward, and negative indications of time (sec) represent time (sec) before impact.

Furthermore, the golf clubs require precise measurement of the dynamic phenomenon due to the inertia of the swing. For example, in a relatively easy test, a rod-like article serving as a club head is fixed to the distal end of a flexible shaft like a fishing rod, and this test tool is subjected to an ideal late-hit golf swing at a moderate speed. With this simulation, the dynamic phenomenon can be confirmed.

As is apparent from the above description, in a dynamic state immediately before impact during swing, a force for moving the club head backward acts on the conventional golf club in a dynamic state immediately before impact due to the elasticity of the shaft. The conventional club head structure has the position of the center of mass such that impact occurs at an instance while the backward dynamic flex of shaft continues. Therefore, the elasticity of the shaft acts as a vector opposite to the ball flying direction at impact when the club head contacts a ball. At an impact away from the center of the hitting face, the elasticity of the shaft acts as a negative force, and the directivity of the hit ball is easily lost. Therefore, it is known that as the elasticity of the shaft is increased, a distance of flight of the ball is decreased under the conditions wherein identical club heads are used with identical grips at identical club head speeds.

The dynamic phenomenon of the shaft causes the club head to accelerate during down swing, and a player feels as if a club head weight were decreased during an important short period of time during the down swing. This feeling is caused by a force flexing the club head end side forward against the elasticity of the shaft (i.e., inertia of the club head). This force corresponds to a force sensed as a force couple with respect to both hands of a player holding a golf club. For a right-hand player, impact occurs at an instance his right hand holds a golf club with a vector opposite to the swing direction and his left hand holds it with a vector in the swing direction. As compared to other sport equipment such as a baseball bat, a tennis racket, and the like, a golf club has an unnatural shape with respect to weight distribution. Such a shape of the golf club makes it difficult for a golf player to perform a perfect golf swing and to retain precise control of the swing path.

The above-mentioned feeling during swing can be easily demonstrated such that shadow swing is performed while the toe side of the club head faces forward or vise versa.

SUMMARY OF THE INVENTION

It is an object of the present invention to provide a through-the-green golf club, a set of golf clubs, and a method of producing the same, which can eliminate the above-mentioned problems of the conventional through-the-green golf clubs and those constituting a set of golf clubs, can improve the direction of a hit ball, and can provide easier swings.

In through-the-green golf clubs and those constituting a set of golf clubs according to the present invention, as shown in FIGS. 1 and 2, a position (**16*a*, 16*b*) of the center of mass of a club head is substantially located in a front portion of a club head with respect to a central longitudinal plane (A—A') which passes through the center of a shaft (11**) and divides the club head into front (hitting face side) and rear portions. Both the flex of shaft due to shock of impact and the dynamic flex of shaft due to inertia are utilized, i.e., elasticity of the shaft is utilized as a force of vector in the ball hitting direction, so as to obtain excellent direction of a hit ball. In addition, since the forces of both hands can be naturally used in the swing direction, the golf club of the present invention provides an easier and correct swing.

Therefore, in a set of golf clubs constituted by the above golf clubs, a distance from the center of mass (**16*a*, 16*b***) of the club head to the central plane (A—A') varies, so that the weight of each club head that a player feels during his swing and near impact (a force for flexing a club head end side against the elasticity of shaft, i.e., a force caused by a distance from the central plane to the center of mass of the club head and the elasticity of shaft) can be adjusted. For example:

(A) A player feels heavier weight as the club length is decreased in correspondence with the club lengths of the respective clubs.

(B) The above-mentioned length is standardized to be inverse proportional to the secondary moments of the golf clubs using the central portion between the both hands holding a golf club (separated from a grip end by about 10.5 cm which may differ in accordance with personal differences) as an axis of rotation.

(C) Or, the length is standardized at a ratio corresponding to natural frequencies of the golf clubs in the set of golf clubs (which are measured while the central portion on the grip space from the grip end by about 10.5 cm is determined as a static end).

(D) The weight of each club that is felt by the plater can be adjusted to a desired value corresponding to the particular function of the club (for example, even if some or all of characteristics of pitching and sand wedges, such as a club length, a secondary moment, or a natural frequency, are the same, they have different functions).

When the above golf club or one in the set of golf clubs is swung, the club head end side is flexed backward as compared to a static state of the golf club, and impact occurs immediately thereafter. FIG. 5 illustrates this case.

DETAILED DESCRIPTION OF THE PREFERRED EMBODIMENTS

An embodiment of the present invention will now be described with reference to the accompanying drawings.

Figure 1:
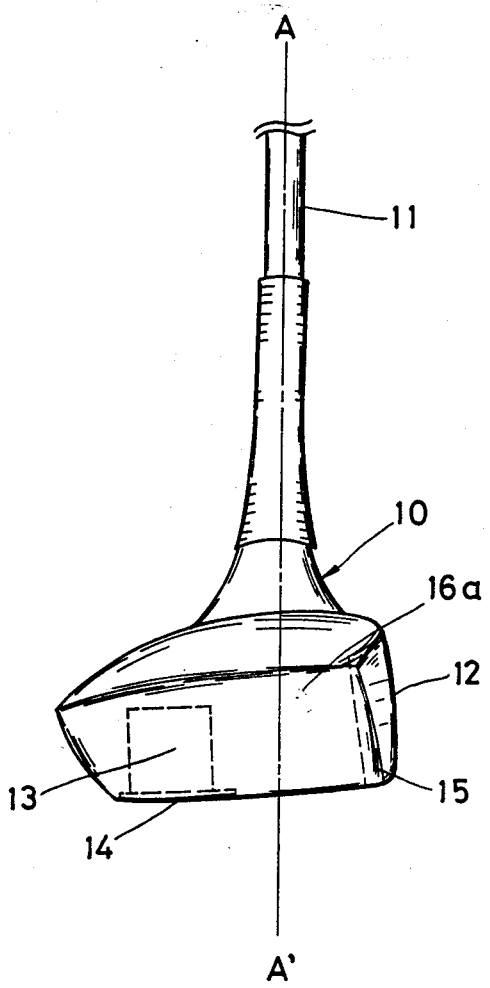
FIG. 1 is a front view of a club head for a wood club according to an embodiment of the present invention when an observer faces a golf player who addresses a ball and observes a club head from the direction toward the toe of the club head.

FIG. 1 shows a head structure of a wood club which is mainly made from a persimmon tree.

As compared to the head structure of a conventional wood club, the club head of the present invention has no sole plate 19, and a central longitudinal plane A—A′ is located slightly behind a hitting face 12. The club head of the present invention comprises a hollow portion 13, and a lower groove of the portion 13 is closed by a wooden plate 14. A face insert 15 is formed of an alloy (beryllium copper). Thus, the position of the center of mass **16*a*** of the club head is located in a front portion adjacent to the central plane A—A′.

Figure 2:
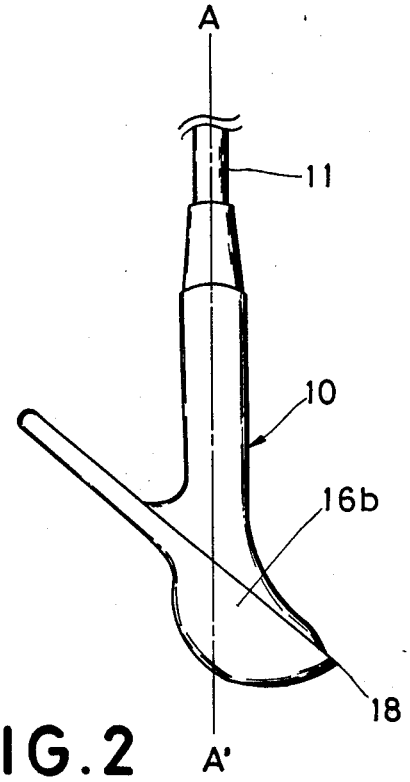
FIG. 2 is a front view of a club head for an iron club according to another embodiment of the present invention when observed from the same direction in FIG. 1.
Figure 3:
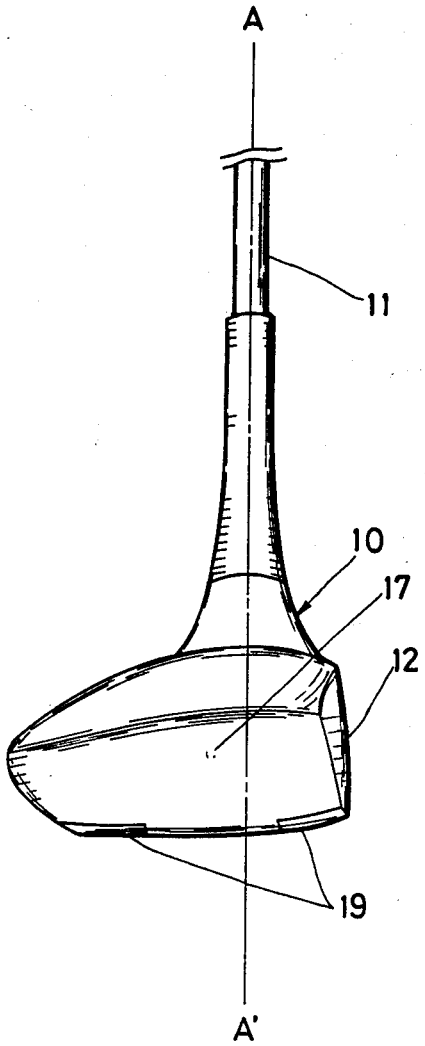
FIGS. 3 and 4 are front views corresponding to FIGS. 1 and 2, respectively showing prior art club heads for wood and iron clubs.
Figure 4:
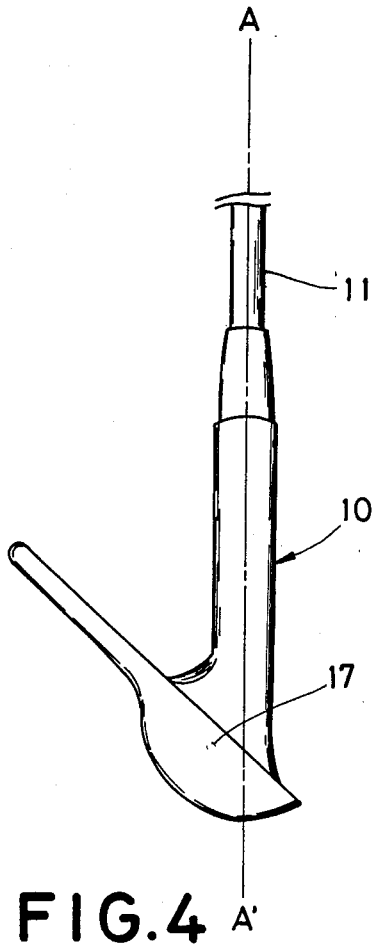
Figure 5:
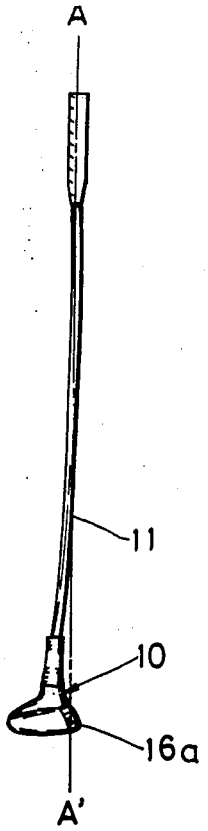
FIG. 5 is a front view showing a dynamic state immediately before impact during swing of a wood club according to the present invention.
Figure 6:
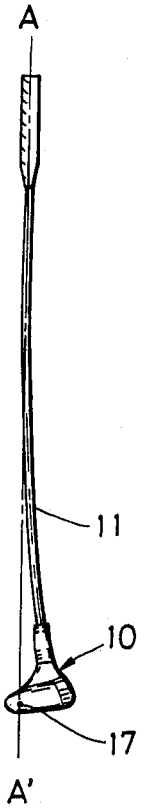
FIG. 6 is a front view showing a dynamic state immediately before impact during swing of a conventional or prior art wood club.
Figure 7:
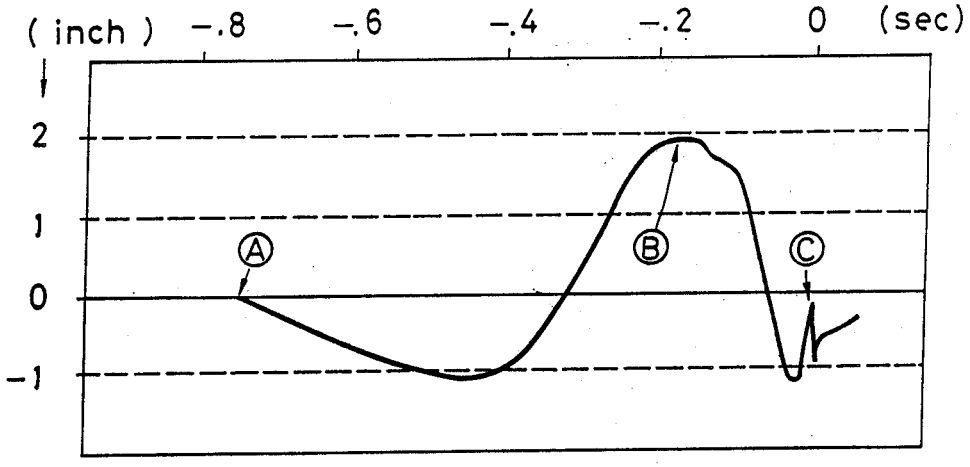
FIG. 7 is an explanatory view of forward and backward movement of a club head from the start of swing to impact of a conventional or prior art wood club.

FIG. 2 shows an example of a club head for an iron club mainly consisting of carbon steel.

As compared to a conventional iron club head, the central plane A—A′ is located slightly behind a leading edge 18, and a position of the center of mass **16*b*** is located in front of the central plane A—A′.

As can be seen from the above description, the center of mass of the club head can be determined at a position according to the present invention by selecting the density of materials constituting the club head and the construction and shape of these materials.

Various modifications may be made in addition to the above embodiments, and the present invention involves these modifications.

According to the present invention, dynamic test results can be provided such that the elasticity of the shaft against the shock of impact and that due to the inertia of swing can be more effectively utilized by the dynamic phenomenon of swing near impact when a golf club according to the present invention is swung. In addition, it is revealed by a hit test that energy conversion between a club head and a golf ball when the ball is appropriately hit can be noticeably improved. and hitting errors can be reduced. Therefore, the excellent direction of a hit ball and easy hitting result can be obtained. It is also found that using a material for the face insert which had a higher hardness than that of a conventional golf club can provide a proper trajectory.

Furthermore, in a set of golf clubs constituted by the above-mentioned golf clubs, the weight of each club head near impact during swing that a player feels can be appropriately adjusted in correspondence with the club length, a function, or the like.

What is claimed is:

1. A golf club which is used for so-called through-the green shots from a tee shot to a shot causing a ball to be on a putting green, wherein said golf club comprises a club head (10) having a striking face defined in part by a leading edge, and a shaft (11) extending from said club head, said club head having a center of mass **(16*a*, 16*b*) substantially located in a front portion in a static state of said golf club with respect to a central plane (A—A′) which passes longitudinally through the center of said shaft substantially parallel to said leading edge (11)** and divides said club head into said front portion containing said striking face and a rear portion.

2. A golf club according to claim 1, wherein said golf club is an iron golf club (including an iron golf club whose club head contains a non-ferrous metal, synthetic resin, or a composite material as a major constituent material).

3. A golf club according to claim 1, wherein said golf club is a wood golf club (including a wood golf club whose club head contains a non-ferrous metal, synthetic resin, or a composite material as a major constituent material).

4. A set of golf clubs which are used for so-called through-the-green shots from a tee shot to a shot causing a ball to be on a putting green and are constituted by a plurality of different golf clubs, wherein each of said golf clubs in said set comprises at least a club head having a striking face defined in part by a leading edge (10) and a shaft extending from said club head (11), and a position of a center of mass **(16*a*, 16*b*) of said club head is substantially located in a front portion of said club head in a static state of said golf club with respect to a central plane (A—A′) which passes longitudinally through the center of said shaft substantially parallel to said leading edge (11**) and divides said club head into said front portion containing said striking face and a rear portion.

5. A method of producing a golf club which comprises a club head (10) having a striking face defined in part by a leading edge and a shaft (11) extending from said club head, and the steps of forming a club head structure such that a position of a center of mass (16*a*, 16*b*) of said club head is substantially located in a front portion at the striking face side of said club head in s static state of said golf club with respect to a central plane (A—A') which passes longitudinally through the center of said shaft substantially parallel to said leading edge (11) and divides said club head into said front portion containing said striking face and a rear portion, and assembling said club head having said club head structure onto an end of said shaft.

6. A method of producing a set of golf clubs which is constituted by a plurality of different golf clubs, each of the golf clubs in said set comprising at least a club head (10) having a striking face defined in part by a leading edge and a shaft (11) extending from said club head, and the steps of forming a club head structure such that a position of a center of mass (16*a*, 16*b*) of said club head is substantially located in a front portion at the striking face side of said club head in s static state of said golf club with respect to a central plane (A—A') which passes longitudinally through the center of said shaft substantially parallel to said leading edge (11) and divides said club head into said front portion containing said striking face and a rear portion, and assembling said plurality of different club heads by mounting each said club head structure onto an end of one of said plurality of shafts.

7. A golf club according to claim 1 wherein said striking face has a face insert therein consisting of metal or metal alloy such that the position of said center of mass is determined in part by said insert.

8. A golf club according to claim 7 wherein said insert is formed of a beryllium copper alloy.

9. A method according to claim 5 and the further step of mounting a face insert consisting of a metal or metal alloy in the striking face of the club head so as to determine in part the position of the center of mass of the club head.

* * * * *